United States Patent [19]

Goerss

[11] 4,219,155

[45] Aug. 26, 1980

[54] HIGH PRESSURE WATER CLEANING DEVICE FOR FLOORS, GRATINGS, AND PAINT LADEN HANDLING DEVICES

[75] Inventor: William G. Goerss, Fenton, Mich.

[73] Assignee: NLB Corporation, Wixom, Mich.

[21] Appl. No.: 934,756

[22] Filed: Aug. 21, 1978

[51] Int. Cl.[2] ..... B05B 3/00

[52] U.S. Cl. ..... 239/124; 15/320; 134/172; 239/231; 239/247; 239/264; 285/190

[58] Field of Search ..... 134/173, 172, 181, 180; 15/320, 345, 385; 239/124, 150, 231, 247, 261, 264, 287, 288.5; 285/150

[56] References Cited

U.S. PATENT DOCUMENTS

| | | | |
|---|---|---|---|
| 2,602,003 | 7/1952 | Wellborn | 239/246 X |
| 3,442,539 | 5/1969 | Randall | 285/190 |
| 3,748,050 | 7/1973 | Poppitz | 239/251 X |
| 3,829,134 | 8/1974 | Hutchison | 285/190 X |
| 4,037,290 | 7/1977 | Rose et al. | 15/345 |
| 4,047,665 | 9/1977 | Moynihan | 239/124 |
| 4,107,816 | 8/1978 | Matthews | 239/225 X |

*Primary Examiner*—Richard A. Schacher
*Attorney, Agent, or Firm*—Cullen, Sloman, Cantor, Grauer, Scott & Rutherford

[57] ABSTRACT

A high-pressure water cleaning device has an enclosure with an open bottom for movement over a floor surface and floor gratings. The cleaning device may be stationary, with objects to be cleaned moved past the enclosure. A rotating seal includes an upright spindle within the enclosure and secured thereto having an axial bore with a high-pressure water inlet and a series of radial discharge ports. A rotatable tubular body is journalled upon the spindle and has an internal annular high-pressure chamber communicating with the discharge ports and a series of radial outlets communicating with the chamber. Tubular arms mounting nozzles are laterally projected into the outlets for rotation with the body, the nozzles being adjusted for delivering streams of high pressure water within the enclosure at high pressure onto floor surfaces and gratings. The tubular body is power rotated. A high pressure dump valve assembly upon the enclosure receives high pressure water from a high pressure water source and has a normal mode zero pressure outlet orifice communicating with the interior of the spray enclosure and a high pressure active mode outlet which communicates with the spindle inlet for delivering high pressure water thereto. A power device is connected to the dump valve for establishing communication of high pressure liquids to the high pressure outlet.

24 Claims, 4 Drawing Figures

HIGH PRESSURE WATER CLEANING DEVICE FOR FLOORS, GRATINGS, AND PAINT LADEN HANDLING DEVICES

BACKGROUND OF THE INVENTION

Heretofore, in the cleaning of floor surfaces and gratings and particularly floor surfaces and gratings within spray booths, the accumulation and build up of paint particles upon the floor surface and gratings has created the problem of effectively removing such accumulated paint from time to time. Various types of caustic and other paint stripping systems have been employed including hot salt bath stripping or the mechanical stripping of accumulated paint upon floors and gratings with accompanying problems producing air polution and the utilization of a second set of removable floor grates that can be used to replace the paint-laden grates.

Various efforts have been heretofore made in order to mechanically remove paint from the floors and gratings of spray booths as well as other dirt and oil accumulations on floor surfaces generally.

SUMMARY OF THE INVENTION

It is an object of the present invention to provide a cleaning device for floors and gratings which incorporates within an open bottom enclosure a rotating seal and a plurality of rotating high pressure water jets which are angularly adjusted in a predetermined pattern for directing high pressure streams of water onto and against surface areas of gratings and floors for mechanically removing paint and dirt accumulation therefrom.

It is another object to provide an improved cleaning device for floors and gratings which eliminates polution problems, eliminates use of caustic chemicals, eliminates one set of floor grates, saves man power normally required in constantly switching clean for dirty grates, eliminates costly caustic and other type of paint-stripping systems and chemicals and eliminates the cost of energy for hot salt bath stripping.

It is another object to incorporate the cleaning device in an automatically driven vehicle to enable the high pressure rotating spray pattern to remove paint from various objects normally used for transporting automobile bodies and parts through paint booths. This method utilizes the same rotating seal as mentioned above.

It is another object of this invention to incorporate the rotating high pressure spray in a stationary enclosure which would be utilized to clean moving paint booth gratings.

It is another object to provide a cleaning unit which could be manually propelled, electric motor propelled, trailed or be stationary with objects to be cleaned moving past the cleaning device.

It is a further object to provide a cleaning device which requires less man power, which is fully safe in operation, incorporates safety controls and in which the cleaning sprays are contained within an enclosure directed onto the surface areas of floors and gratings.

These and other objects will be seen from the following specification and claims in conjunction with the appended drawings.

THE DRAWINGS

It is understood that the above drawing illustrates merely a preferred embodiment of the invention directed to the cleaning device for floors and gratings and the method of paint removal, and that other embodiments are contemplated within the scope of the claims hereafter set forth.

DETAILED DESCRIPTION OF THE INVENTION

Figure 1:
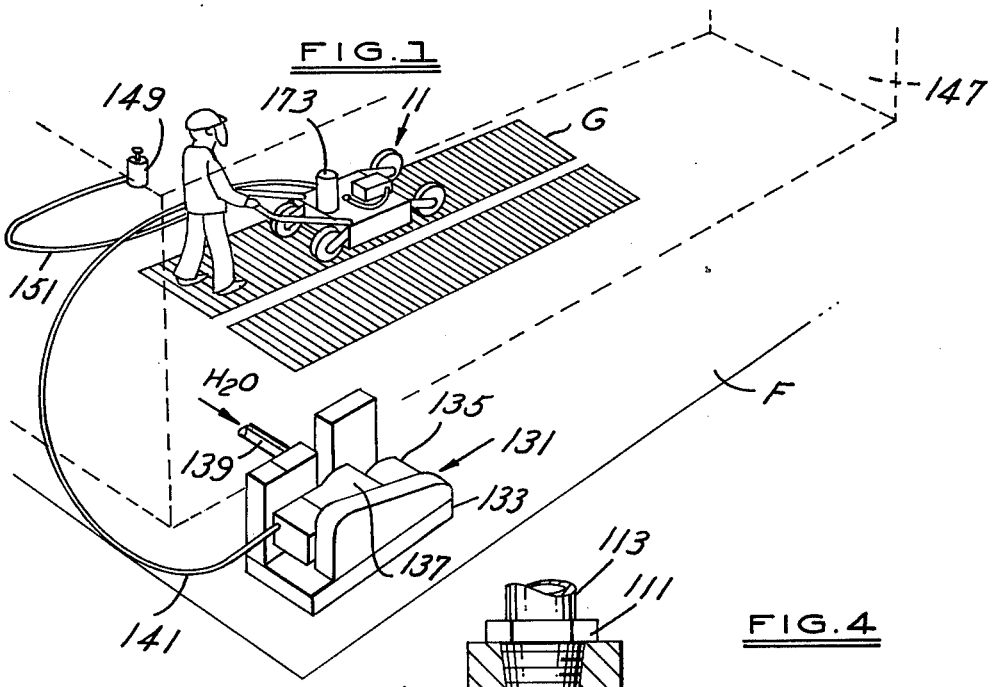
FIG. 1 is a schematic fragmentary perspective view showing a floor and grating as a part of a paint spray booth to which the present cleaning device is applied.

Referring to the drawings, FIG. 1 shows fragmentarily a floor F and conventional type of gratings G found within spray-painting booths such as the booth 147, fragmentarily shown wherein, there is an accumulation from time to time of paint drippings upon the floor and grating surfaces requiring cleaning and removal.

The present invention in one embodiment is directed to a manually or otherwise propelled cleaning device for floors and gratings as well as the method of removing paint and other particles and dirt from such floors and gratings. As shown in FIG. 1, there is movably positioned upon the grating G. and/or the floor surface F the present manually propelled cleaning device or unit 11 referred to as a floor and grating cleaning unit.

Figure 4:
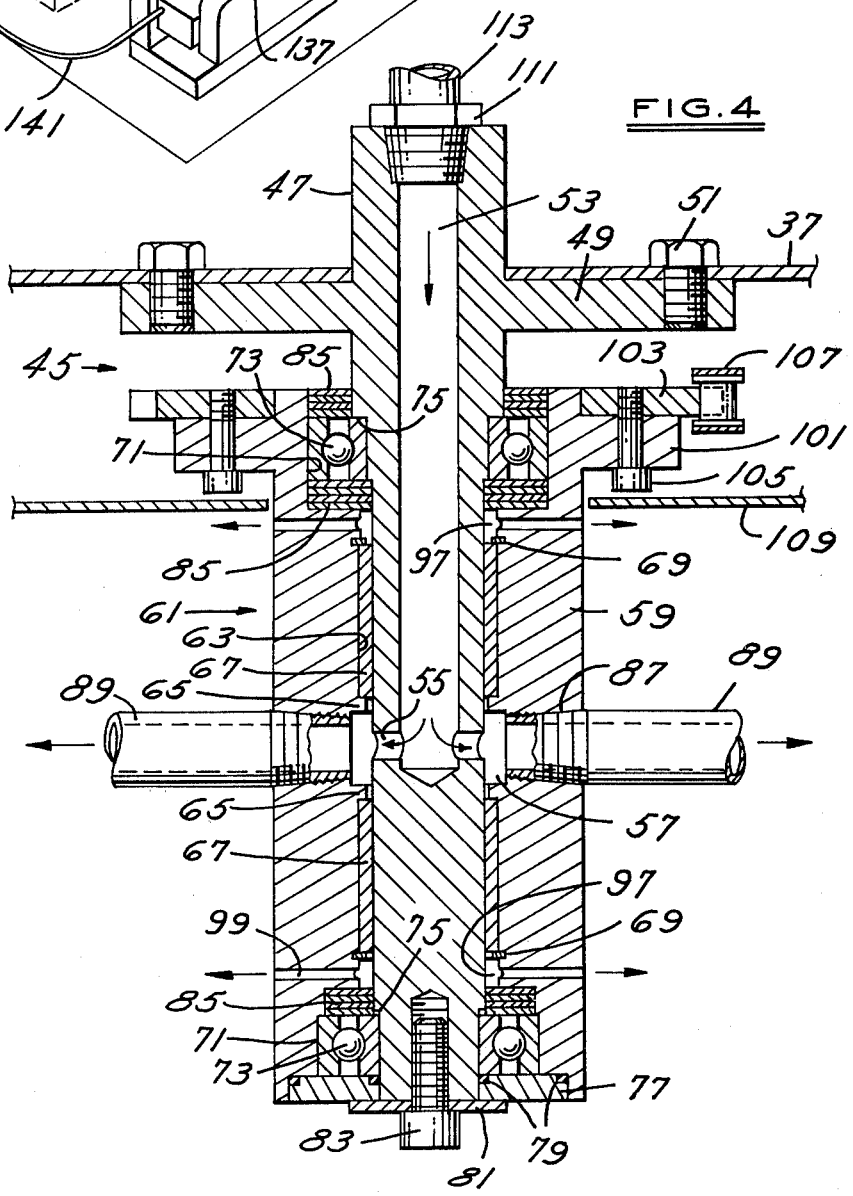
FIG. 4 is a fragmentary section of the rotating seal including the spindle and body taken in the direction of arrows 4—4 of FIG. 2, on an increased scale.

The cleaning unit 11 includes the spray enclosure 13 having upright side walls and a top wall 37, FIGS. 1 and 4, and an open bottom. Peripheral splash guard skirting 15 is arranged around the side walls of the enclosure 13 removably secured thereto as by fasteners 17, with the lower edges of the splash guard 15 adjacent or below the lower edges of the enclosure side walls and normally spaced a short distance above the floor surface F, FIG. 2.

Bifurcated wheel supports 21 project angularly downward from the end walls of the enclosure 13 and are suitably secured thereto as by welding for supporting the wheels 23 having axles 25. The wheels 23 include heavy duty tires for movably mounting the spray enclosure 13 with its bottom closely adjacent the floor surface F as indicated by the clearance 27, FIG. 2. The open bottom of the spray enclosure 13 is in communication with spray chamber 19 to facilitate the application of streams of high jet pressure fluids upon the floor surface F and the gratings G over which the cleaning device 11 is movably and manually transported.

The U-shape tubular handle 29 has closed ends whose bifurcations 31 are pivotally connected at 33 to the brackets 35 upon the top wall 37 of the enclosure 13. The adjustable handle support 41 interconnects at least one of the axles 25 and handle 29 as by the adjustable clamp 43 to facilitate angular adjustment of the handle 29 to meet the needs of the attendant using the cleaning device 11 as in FIG. 1.

Figure 2:
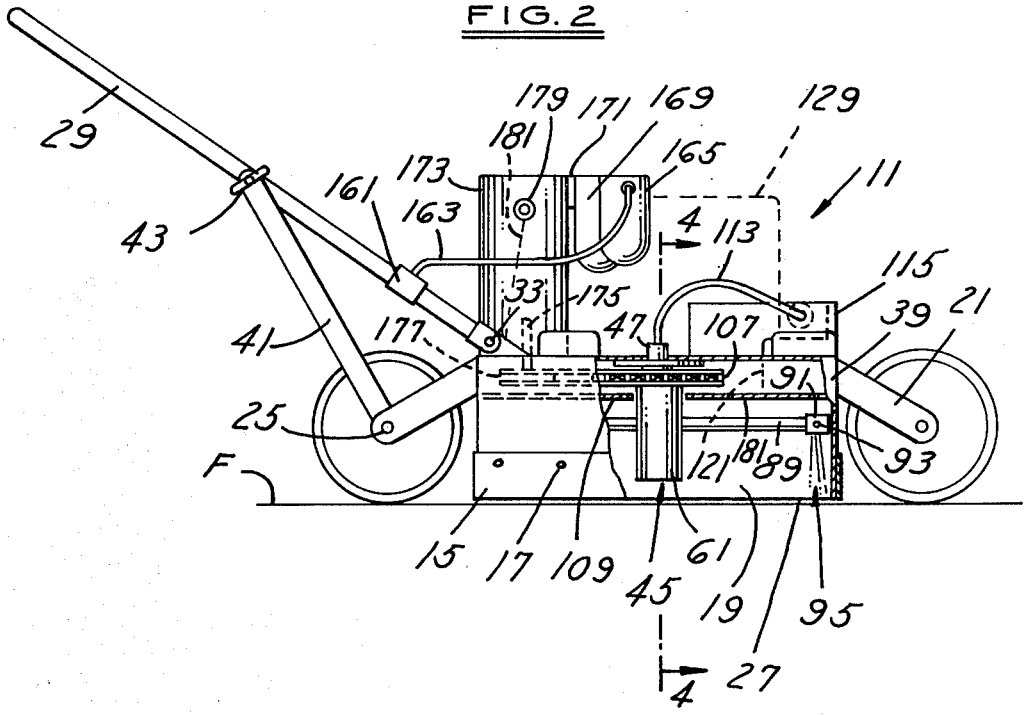
FIG. 2 is a side elevational view of the manually propelled cleaning device for floors and gratings shown in FIG. 1, on an increased scale.

The heart of the present invention is the rotating seal assembly generally indicated at 45, FIGS. 2 and 4, which is mounted within chamber 19 of the spray enclosure 13. The rotating seal assembly 45 includes the upright spindle 47 whose mount flange 49 bears against the undersurface of top wall 37 and is secured thereto by fasteners 51.

The spindle 47 projects through top wall 37, and includes a longitudinal bore 53 which terminates intermediate the ends of the spindle 47 in a series of radial discharge ports 55, FIG. 4. The upper end of the spindle 47 has a high pressure inlet adapted to receive the fitting 111 and the water pipe 113, fragmentarily shown.

In addition to the spindle 47, the rotating seal assembly 47 includes the rotating seal 61 having an elongated body 59 and a longitudinal bore 63 which receives and encloses a major portion of the spindle 41 below top wall 37 within the chamber 19 of the spray enclosure.

The body 59 intermediate its ends has formed therein an annular high pressure water chamber 57 arranged radially outward of the high pressure discharge ports 55. Also formed through the body 59 are a plurality of outlets 87 in communication with water chamber 57, into which are projected threadedly or otherwise secured the inner ends of the radially extending nozzle arms 89, fragmentarily shown in FIG. 4 and also shown in FIG. 2.

Within and adjacent the bore 63 of the body 59 are a pair of spaced shoulders 65 against which bear a pair of elongated bushing seals 67, preferably made of a phosphor bronze, snugly held within the bore 63 and retained in position by the lock rings 69. The opposite ends of the body 59 have counter bores 71 within which are nested precision ball bearings 73. Portions of the bearings 73 receive the spindle 47 and cooperatively engage the corresponding shoulders 75 thereon by which the body 59 is supported and journalled with respect to the stationary spindle 47.

Cover 77 employing inner and outer O-rings 79 is nested and sealed within the lower end of the body 59 and around the lower end of the spindle 47 and is retained relative to the body 59 and the lower ball bearing 73 by washer 81 and an axial fastener 83. A series of water seals 85 extend into the corresponding bores 71 within the body 59 above and below the top ball bearing assembly 73, and above the bottom ball bearing assembly 73 to keep the respective ball bearings 73 dry and to exclude water therefrom.

Figure 3:
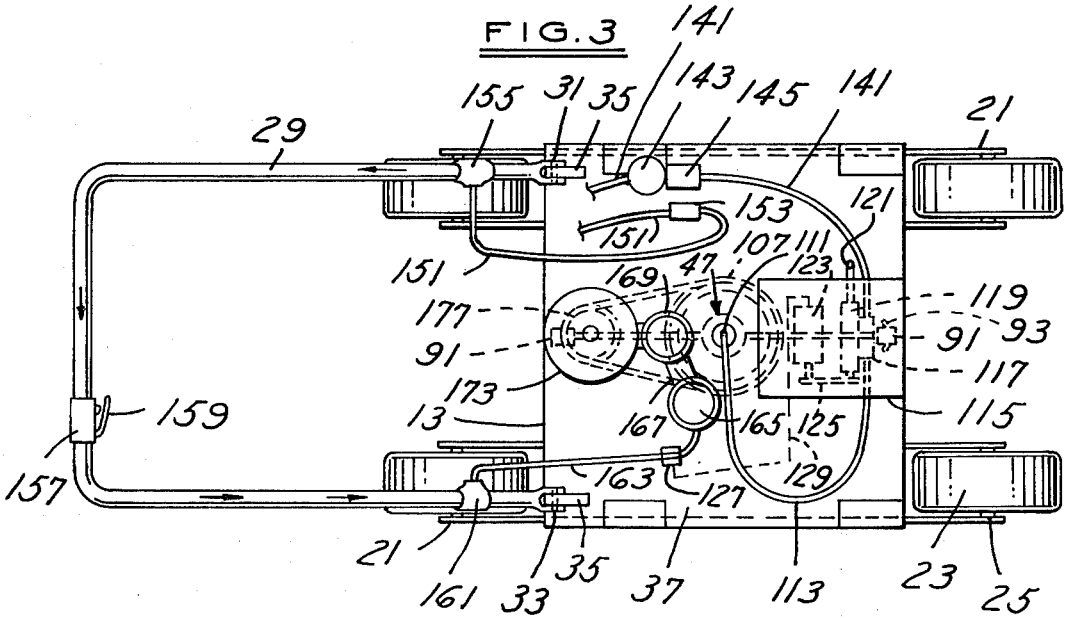
FIG. 3 is a plan view thereof.

As shown in FIGS. 2 and 3, adjustable nozzle blocks 91 are mounted upon the ends of the nozzle arms 89, each adapted to adjustably support one or a plurality of angularly disposed nozzles 93. The nozzles 93 are adjusted so as to establish a predetermined spray pattern such as shown at 95, FIG. 2, for the impingement of high pressure jets of water onto the floor and grating surfaces with the nozzle arms 89 adapted to rotate and sweep over the floor or grating surface as the spray enclosure 13 is slowly propelled manually thereover.

Referring to FIG. 4, between the spindle 47 and the rotating body 59 longitudinally outward of the ends of the respective bushing seals 67 are a pair of water drain cavities 97 which communicate with the radial opposed pairs of drains 99 to permit escape of high pressure lubricating water as may pass between the bushings 67 and the spindle 47, said drains 99 communicating with chamber 19 of the spray enclosure 13. Body 59 at its upper end has an annular gear mount flange 101 over which is assembled the sprocket gear 103 secured thereto by fasteners 105.

In FIG. 4, a continuous sprocket chain 107 is fragmentarily shown which extends around the sprocket gear 103 and forms a part of the intermeshing gear arrangement of FIG. 2 for power rotating the seal 61 and corresponding rotation of the nozzle arms 89. A chain guard plate 109, apertured to receive rotating seal 61 spans the respective side walls of the spray enclosure 13 and is secured thereto for protectively separating the drive mechanism including the chain and sprockets from the water being sprayed within chamber 19 down onto the floor and grating surfaces.

A high pressure water dump valve housing 115 overlies and is secured to the top wall 37 of the spray enclosure 13. Schematically shown in FIG. 3 and within the dump valve housing, there is provided a dump valve 119 having a dump valve bypass outlet 117 adapted for delivering high pressure water through the conduit 113 to the inlet fitting 111 at the top of the spindle 47 as in FIGS. 2, 3 and 4.

The dump valve 119 also includes a low or zero pressure enlarged orifice 121 which is in communication with the chamber 19 of the spray enclosure 13. The dump valve includes longitudinally movable dump valve element 125 therein which in the static mode is normally biased to such a position as to leave the zero pressure dump valve 119 orifice 121 open leaving a small amount of water to pass through conduit 113 to inlet 111 under zero or low pressure.

The normally open dump valve orifice outlet is generally indicated at 121, FIG. 3, as extending from the dump valve body or housing 115 down into the chamber 19.

A suitable power means is employed for changing the position of the movable valve element 125 within the dump valve body 115. Such power means includes a pneumatic control cylinder 123 mounted upon the dump valve housing having a piston and piston rod which is connected to the dump valve element 125.

From a suitable fitting 127 applied to the high pressure air conduit 163, FIG. 3, there extends an air conduit 129 which is connected to the control cylinder 123 so that when the high pressure air is moving through conduit 163 and conduit 129, the power cylinder 123 is activated and the valve element 125 moved so as to close the dump valve low pressure orifice 121 and force all the water flow into the nozzles thereby creating a restriction and causing the water pressure to rise to a preset level.

As shown in FIG. 1, there is provided a high pressure pump assembly 131 having a base 133 positioned upon the floor surface F, and includes a motor 135 for driving a pump 137 having a suitable intake 139 to a water supply. A high pressure water delivery hose or pipe 141 extends from the pump 137 to the cleaning device 11.

As shown in FIG. 3, connected to the water supply hose 141 is a filter 143. The filter incorporates a 200 mesh filter 143 rated for 10,000 psi operating pressure for removing particles from incoming water since clean water is essential to long operating life of the rotating seal assembly 45. High pressure water from the filter 143 is directed through the bracket 145 and continues through the conduit 141 into the dump valve housing 115 for connection to the inlet of the dump valve 119.

A high pressure air supply with pressures between 60 and 90 psi is generally indicated at 149, FIG. 1, and is adapted for delivering such high pressure air through the air hose 151 through the supporting bracket 153 upon the top wall 37 of the spray enclosure 13 for connection with the fitting 155 upon one leg of the U-shaped tubular handle 29, whose free ends are closed.

Mounted upon the bight of the U-shaped handle at a convenient location for the attendant is the normally closed quick-release air valve 157 with a handle 159 which controls the flow of high pressure air through the tubular handle 29 and to the outlet fitting 161 on the other leg of the handle 29.

Air conduit 163 connects the fitting 161 for delivering high pressure air to the air filter 165. The air filter 165 is rated for 105 cfm flow rate with a maximum air pressure 250 psi. The filter 165 incorporates, for illustration, a 50 micron filter for removal of liquid and solid particles. High pressure air from the air hose 163 passes through the filter 165, through an additional conduit 167 passes through the air lubricator 169 upon the bracket 171 through a corresponding conduit to the air drive motor 173.

The motor 173 is mounted and suitably secured upon the top wall 37 of the spray enclosure 13. The air motor 173 is of a conventional construction and in the illustrative embodiment, is an axial piston air motor rated for the required horse power with 90 psi air pressure and 62 cfm air volume. The air motor 173 includes at the lower end thereof an output shaft 175 which extends through the top wall 37 of the spray enclosure 13 and at its lower end, mounts the drive sprocket 177 which through the chain 107 is connected to the driven sprocket 103 upon the seal body 59.

Applied to the air motor 173 is a suitable exhaust valve 179 with outlet, whereby, regulation of the valve 179 may control the speed of operation of the air motor 173.

The conduit 181, fragmentarily shown, extends from the exhaust valve 179 of the air motor 173 down into the chamber 19 which encloses the gear mechanism, namely, the sprockets and chain 107 so that particles of oil within the air from the air lubricator 169 may be employed for lubrication of the sprocket chain 107 and sprocket gears 103 and 107.

In the illustrative embodiment, the air lubricator 169 has an adjustable micro-fog unit which includes a transparent bowl with metal guard and has a one-half pint oil capacity rated for 250 psi maximum air pressure. Oil-ladden exhaust air through the exhaust valve outlet 179 is thus directed by conduit 181 across the chain guard enclosure and past the chain 107 for continuous lubrication thereof.

OPERATION

The present rotating seal assembly 45, FIG. 4, consists of two major units, a stationary spindle 47 and the rotating body 59. The rotating body 59 incorporates a pair of close tolerance fine finish bronze seals 67 secured to the body 59 and which rotate about the spindle, one above the spindle 47 discharge ports 55 and one below said ports. The rotating body 59 also includes at the top and bottom thereof, precision ball bearings 73 adapted to react to all of the various side loads imposed on the body 59 by the thrust of the high pressure nozzles 93, FIGS. 2 and 3. Sufficient water for lubrication is allowed to pass from the high pressure chamber 57 through the seals 67 and into the drain cavities 97 for outlet through the drains 99.

The ball bearings 73 are completely protected from water by the seals 85 upon both sides of the upper ball bearing 73 and upon the top of the lower ball bearing 73.

In the illustrative embodiment, spindle 47 includes four radial discharge ports 55 for flow of water into the high pressure chamber 57 which completely surrounds the discharge ports 55, assuring a continuous and uninterrupted flow of high pressure water to the respective nozzle arms 89. The surfaces of the spindle 47 are precision-machined to provide minimum friction and maximum sealing capabilities.

In normal operation with the cleaning device 11 for floors and gratings, particularly the floors F and gratings G of spray paint booths and the like manually propelled thereover as shown in FIG. 1, water under high pressure is delivered through the hose 141 connected to the high pressure pump assembly 131. Thus, water under pressure is delivered to the dump valve housing 115 and the dump valve 119 therein. In the normal mode, the aforesaid dump valve, its movable valve element 125 is normally biased to such position to allow water to flow at reduced pressure through the large orifice 121 within the dump valve body 115 down into the chamber 19 of the spray enclosure 13.

At the same time, high pressure air from the source 149 is delivered through conduit 151 to fitting 155 of the handle 29. The high pressure air communicates through the handle 29 and with the normally closed control valve 157 having a trigger handle 159 for opening the same, normally controlling the flow of high pressure air through the other leg of the U-shaped handle 29, as in FIG. 3. Once the valve 157 has been manually opened, high pressure air is delivered through the fitting 161 and air conduit 163 through air filter 165 through air lubricator 169 and the conduit connection 167 into air motor 173 for driving the motor 173 and its rotatable output shaft 175.

Accordingly, on manual opening of the air valve 157 by squeezing the handle 159, which is normally spring-biased to open position shown, FIG. 3, air motor 173 is activated and its output shaft 175 drives the sprocket 177 and chain 107 and the corresponding sprocket 103 upon the rotating seal body 59. This causes a predetermined speed of rotation of the seal body 59 and the laterally projecting nozzle arms 89. The arms mount adjustable nozzle blocks 91 which mount one or a plurality of spray nozzles 93 to provide as determined the inward and outward spray pattern.

The respective nozzles 93 incorporate tungsten carbide spray tips which are especially designed for removing paint accumulations from floor gratings and from floors and for that matter, for the removal of dirt or oil or other refuse from floor surfaces generally.

At the same time as high pressure air flow is transmitted through the hollow handle 29 and through the conduit 163 and conduits 167 to the air motor 173, the branch air conduit 129, FIG. 3, from the fitting 127 delivers high pressure air to the control cylinder 119. This switches the dump valve 119 from a static mode to an operating mode causing the valve element 125 to move to close off the dump orifice 121 and to force all high pressure water from conduit 141 through the valve body 115 and through the high pressure water outlet 117 and conduit 113 to the inlet 111 at the top of the stationary spindle 47.

Thus, the water under high pressure is now delivered at a flow rate up to 40 gallons per minute through the spindle 47 and to the power rotated bushing body 59 for delivering high pressure water through the nozzle arms 89 and through the respective nozzles 93 at a predetermined pressure in the range up to 10,000 psi. The body 59 carrying the jets or nozzles 93 is rotated a speed up to 120 RPM.

At the same time as the water is delivered under such high pressure, the air motor 173 is effective to provide continuous rotation of the body 59, so that there is, in effect, a scouring action of the streams or jets of high pressure water in a predetermined pattern directed down onto the floor surface F or grating surface G directly below the spray enclosure 13.

The present invention is also directed to a method of removing paint from floor surfaces F and floor gratings G and as equivalent thereto, a method which provides for the removal of dirt or oil or other accumulations upon any floor surface. The method includes the following steps:

1. Supporting one or more or a series of high pressure water jets above a floor surface F or a grating G within the floor surface;

2. A further step includes directing said jets of high pressure water so as to impinge upon the floor surface F and grating G. and confining the jets to a limited area;

3. As a third step, simultaneously rotating the water jets to sweep over surface F areas of the floor surface and gratings G. and;

4. The final step of movably transporting the water jets over and along surface portions of the floor F and grating G. for, in effect, blasting and removing paint particles and other accumulations from surfaces thereof.

It is the rotary high pressure spray action of the jets which cleans the sides and top of the grating components or the floor surface as the unit moves in any direction thereover. The operator moves the floor cleaner or cleaning device 11 at a rate necessary for cleaning floor grates and floor surfaces as required.

The high pressure air source at 149 supplies air at 60 to 90 psi for rotating the high pressure nozzles 93 and for controlling the high pressure dump valve 119.

Having described my invention, reference should now be had to the following claims.

I claim:

1. A cleaning device for discharging cleaning fluid under high pressure towards a surface comprising a hollow spray enclosure having top and side walls and an open bottom; said top wall having inner and outer surfaces;

a rotating seal including an upright spindle within said enclosure secured to and projecting above said top wall;

said spindle having an axial bore with a high pressure fluid inlet at the top thereof;

said bore extending for a portion of the length of said spindle and terminating in a plurality of radial discharge ports;

said seal including a rotatable tubular body sealingly journalled and supported upon and enclosing said spindle;

said body having an internal annular high pressure fluid chamber communicating with said discharge ports, and a plurality of radial outlets communicating with said chamber;

laterally disposed tubular nozzle arms at their inner ends projected into said outlets and secured to said body for rotation therewith within said enclosure;

a nozzle adjustably mounted upon an end portion of each arm for delivering streams of high pressure fluid within said enclosure and downwardly in a predetermined pattern upon the surface;

rotative power means on said top wall connected to said body;

said power means including a motor located opposite the outer surface of said top wall and having an axial drive shaft projected through said top wall into said enclosure;

means connecting said shaft to said body;

said spindle including a radial flange bearing against the inner surface of said top wall and secured thereto;

said body including a pair of bushing seals mounted within and upon said body, said bushing seals being located above and below said body fluid chamber and said discharge ports;

precision ball bearings mounted within said body adjacent opposite ends thereof in registry with said spindle;

means supporting and retaining said body against endwise movement relative to said spindle including a pair of stop shoulders upon said spindle, engaging said bearings and a pair of stop shoulders within said body supporting said bearings;

a bearing cover within the lower end of said body supportively engaging the adjacent ball bearing, and sealed with respect to said spindle and body;

fastening means for holding said cover in said body; and a series of annular seals within said body interposed between said body and spindle upon the top and bottom of one ball bearing and upon the top of the other ball bearing respectively for excluding fluid from said bearings.

2. In the cleaning device of claim 1, said connecting means including interconnected gear means on said shaft and said body; said gear means including sprocket gears on said shaft and body and a connecting sprocket chain.

3. In the cleaning device of claim 1, said motor being an air-driven motor;

and a hose connected to said motor and to a source of high pressure air.

4. In the cleaning device of claim 3, said motor operating at approximately 90 psi air pressure and at an air volume of 62 cfm, approximately.

5. In the cleaning device of claim 3, an air filter connected with said air hose upstream of said air motor.

6. In the cleaning device of claim 5, and an air lubricator connected into said air hose interposed between said filter and air motor.

7. In the cleaning device of claim 3, wherein said fluid is water; a source of water under high pressure;

and a water conduit interconnecting said water source and said spindle water inlet.

8. In the cleaning device of claim 7, the water source including a power driven pump having an outlet connected to said water conduit.

9. In the cleaning device of claim 7, a high pressure dump valve enclosure mounted upon said top wall;

a dump valve within said latter enclosure, the connection of said water conduit to said spindle inlet including a portion of said water conduit extending into said dump valve enclosure and connected to said dump valve;

said dump valve having a normal mode zero pressure outlet orifice communicating with the interior of said spray enclosure and a high pressure active mode outlet;

a portion of said water conduit interconnecting said high pressure outlet and spindle inlet;

and a power control means connected to said dump valve for switching said dump valve from passive mode to active mode so that high pressure water passes through said high pressure dump valve outlet to said spindle.

10. In the cleaning device of claim 9, said power control means including an air cylinder having the reciprocal piston rod;

a movable valve element within said dump valve normally biased to dump position, said piston rod being connected to said movable valve element;

and a conduit interconnecting said air cylinder and said source of high pressure air whereby upon application of high pressure air to said cylinder, said piston rod moves said valve element closing the low pressure orifice and causing all water to flow to said nozzles.

11. In the cleaning device of claim 10, a normally closed quick-release manual air valve on said air hose controlling flow of air therethrough;

said conduit to said air cylinder being connected to said air hose downstream of said air valve.

12. In the cleaning device of claim 3, a water guard plate within and spanning said spray enclosure side walls above said nozzle arms and adjacent said gear means;

an air lubricator with an oil spray supply connected into said air hose interposed in the conduit to said air motor;

said air motor having an exhaust port;

and conduit means connecting said port to the interior of said enclosure above said water guard plate for directing oil-laden air past the gear means for lubrication.

13. In the cleaning device of claim 1, a U-shaped angularly adjustable tubular handle with its ends pivotally connected to said enclosure.

14. In the cleaning device of claim 1, a peripheral splash guard skirting removably mounted upon and around said enclosure side walls extending to at least the lower edges thereof.

15. In the cleaning device of claim 1, said bushing seals being of phosphor bronze.

16. In the cleaning device of claim 1, there being annular drain cavities between said body and spindle longitudinally outwardly of said bushing seals respectively, and a plurality of radial fluid drains through said body communicating with said drain cavities;

whereby some high pressure fluid from said high pressure fluid chamber passes through said bushing seals and into said drain cavities thereby lubricating said bushing seals.

17. In the cleaning device of claim 1, the mounting of said nozzles including a nozzle block upon the end of each nozzle arm in communication therewith, said nozzles being adjustably mounted upon said blocks for adjustably regulating spray pattern.

18. In the cleaning device of claim 1, a water guard plate within and spanning said spray enclosure side walls above said nozzle arms and adjacent said connecting means.

19. A cleaning device for floors and gratings comprising a hollow spray enclosure having top and side walls and an open bottom;

wheels journalled upon and movably supporting said enclosure with its bottom closely adjacent a floor surface;

a rotating seal including an upright spindle within said enclosure secured to and projecting above said top wall;

said spindle having an axial bore with a high pressure water inlet at the top thereof;

said bore extending for a portion of the length of said spindle and terminating in a plurality of radial discharge ports;

said seal including a rotatable tubular body sealingly journalled and supported upon and enclosing said spindle;

said body having an internal annular high pressure water chamber communicating with said discharge ports, and a plurality of radial outlets communicating with said chamber;

laterally disposed tubular nozzle arms at their inner ends projected into said outlets and secured to said body for rotation therewith within said enclosure;

a nozzle adjustably mounted upon an end portion of each arm for delivering streams of high pressure water within said enclosure and downwardly in a predetermined pattern upon the floor surface or a grating therein;

rotative power means on said top wall connected to said body;

said power means including a motor having an axial drive shaft projected into said enclosure;

interconnected gear means on said shaft and body;

said motor being an air-driven motor;

a hose connected to said motor and to a source of high pressure air;

a U-shaped angularly adjustable tubular handle having closed ends pivotally connected to said enclosure;

the connection of said air hose to said air motor including a portion of said hose connected to said handle upon one leg thereof;

a portion of said air hose interconnecting the other leg of said handle and said air motor;

and a normally closed quick release manual air valve upon the bight of said handle controlling the flow of high pressure air passing through said handle.

20. A spray device working in the approximate range of 10,000 psi and below comprising a hollow spray enclosure having top and side walls and an open bottom;

a high pressure rotating seal including an upright spindle within said enclosure secured to and projecting above said top wall;

said spindle having an axial bore with a high pressure water inlet at the top thereof;

said bore extending for a portion of the length of said spindle and terminating in a plurality of radial discharge ports;

said seal including a rotatable tubular body sealingly journalled and supported upon and enclosing said spindle;

said body having an internal annular high pressure water chamber communicating with said discharge ports, and a plurality of radial outlets communicating with said chamber;

laterally disposed tubular nozzle arms at their inner ends projected into said outlets and secured to said body for rotation therewith within said enclosure;

a nozzle adjustably mounted upon an end portion of each arm for delivering streams of high pressure water within said enclosure and downwardly in a predetermined pattern upon the floor surface or a grating therein;

rotative power means on said top wall connected to said body;

the journalling of said body including a pair of bushing seals mounted within and upon said body above and below said body water chamber and discharge ports;

precision ball bearings mounted within said body adjacent the top and bottom thereof in registry with said spindle;

means supporting and retaining said body against endwise movement relative to said spindle including a pair of stop shoulders upon said spindle engaging said bearings, and a pair of shoulders within said body supporting said bearings;

a bearing cover within the lower end of said body supportively engaging the adjacent ball bearing, and sealed with respect to said spindle and body;

a washer secured upon the lower end of said spindle and engaging said cover; and a series of annular water seals within said body interposed between said body and spindle upon the top and bottom of one ball bearing and upon the top of the other ball bearing respectively excluding water therefrom.

21. The spray device of claim 20, there being annular drain cavities between said body and spindle longitudinally outward of said bushing seals respectively;

and a plurality of radial water drains through said body communicating with said drain cavities;

whereby high pressure water from said high pressure water chamber passes through said bushing seals and into said drain cavities thereby lubricating said bushing seals.

22. A cleaning device for discharging cleaning fluid towards a surface comprising a hollow spray enclosure having top and side walls and an open bottom; said top wall having inner and outer surfaces;

a rotating seal including an upright spindle within said enclosure secured to and projecting above said top wall;

said spindle having an axial bore with a high pressure fluid inlet at the top thereof;

said bore extending for a portion of the length of said spindle and terminating in a plurality of radial discharge ports;

said seal including a rotatable tubular body sealingly journalled and supported upon and enclosing said spindle;

said body having an internal high pressure fluid chamber communicating with said discharge ports, and a plurality of radial outlets communicating with said chamber;

laterally disposed tubular nozzle arms at their inner ends projected into said outlets and secured to said body for rotation therewith within said enclosure;

a nozzle adjustably mounted upon an end portion of each arm for delivering streams of high pressure fluid within said enclosure and downwardly in a predetermined pattern upon the surface;

rotative power means on said top wall connected to said body;

said power means including a motor located opposite the outer surface of said top wall and having an axial drive shaft projected through said top wall into said enclosure;

interconnected gear means on said shaft and body;

said gear means including sprocket gears on said shaft and body and a connecting sprocket chain;

said spindle including a radial flange bearing against the inner surface of said top wall and secured thereto;

said body including a pair of bushing seals mounted within and upon said body, said bushing seals being located above and below said body fluid chamber and said discharge ports;

precision ball bearings mounted within said body adjacent opposite ends thereof in registry with said spindle;

means supporting and retaining said body against endwise movement relative to said spindle including a pair of stop shoulders upon said spindle; engaging said bearings and a pair of stop shoulders within said body supporting said bearings;

a bearing cover within the lower end of said body supportively engaging the adjacent ball bearing, and sealed with respect to said spindle and body;

fastening means secured upon the lower end of said spindle and engaging said cover;

a series of annular seals within said body interposed between said body and spindle upon the top and bottom of one ball bearing and upon the top of the other ball bearing respectively for excluding fluid from the bearings;

annular drain cavities between said body and spindle longitudinally outwardly of said bushing seals respectively, and a plurality of radial fluid drains through said body communicating with said drain cavities;

whereby some high pressure fluid from said high pressure fluid chamber passes through said bushing seals and into said drain cavities thereby lubricating said bushing seals.

23. The cleaning device defined in claim 22 wherein said motor is air-driven, and a hose connected to said motor and to a source of high pressure air.

24. A high pressure rotating seal for use in a liquid cleaning device working in the approximate range of 10,000 psi and below comprising a spindle having an axial bore with a high pressure liquid inlet at one end thereof;

said bore extending for a portion of the length of said spindle and terminating in a plurality of radial discharge ports;

a rotatable tubular body sealingly journalled and supported upon and enclosing said spindle;

said body having an internal annular high pressure liquid chamber communicating with said discharge ports, and a plurality of radial outlets communicating with said chamber;

said body including a pair of bushing seals mounted within and upon said body, said bushing seals being located above and below said body liquid chamber and said discharge ports;

precision ball bearings mounted within said body adjacent opposite ends thereof in registry with said spindle;

means supporting and retaining said body against endwise movement relative to said spindle including a pair of stop shoulders upon said spindle, engaging said bearings and a pair of stop shoulders within said body supporting said bearings;

a bearing cover within the other end of said body supportively engaging the adjacent ball bearing, and sealed with respect to said spindle and body;

fastening means secured upon said other end of said spindle and engaging said cover;

a series of annular seals within said body interposed between said body and spindle upon opposite sides of one ball bearing and upon one side of the other ball bearing respectively for excluding liquid from the said ball bearings;

annular drain cavities between said body and spindle longitudinally outwardly of said bushing seals respectively, and a plurality of radial liquid drains through said body communicating with said drain cavities; and whereby some high pressure liquid from said high pressure chamber is adapted to pass through said bushing seals and into said drain cavities for lubricating said bushing seals.

* * * * *